US007636447B2

(12) United States Patent
Saint-Vincent et al.

(10) Patent No.: US 7,636,447 B2
(45) Date of Patent: Dec. 22, 2009

(54) ACOUSTIC BRACKET SYSTEM

(75) Inventors: Stephen Saint-Vincent, Ames, IA (US); John Koval, Santa Ana, CA (US); Christopher E. Combest, Leawood, KS (US)

(73) Assignee: Multi Service Corporation, Overland Park, KS (US)

( * ) Notice: Subject to any disclaimer, the term of this patent is extended or adjusted under 35 U.S.C. 154(b) by 958 days.

(21) Appl. No.: 11/077,274

(22) Filed: Mar. 10, 2005

(65) Prior Publication Data

US 2005/0201571 A1 Sep. 15, 2005

Related U.S. Application Data

(60) Provisional application No. 60/552,776, filed on Mar. 12, 2004.

(51) Int. Cl.
*H04R 25/00* (2006.01)

(52) U.S. Cl. ..... 381/152; 381/332; 181/150

(58) Field of Classification Search ..... 381/152, 381/345, 87, 332; 181/150, 199, 148, 151
See application file for complete search history.

(56) References Cited

U.S. PATENT DOCUMENTS

| | | | | |
|---|---|---|---|---|
| 2,341,275 | A | 2/1944 | Holland | |
| 3,449,531 | A | 6/1969 | Ashworth | |
| 3,609,253 | A | 9/1971 | Ashworth | |
| 3,728,497 | A * | 4/1973 | Komatsu, Akira | 381/392 |
| 3,925,627 | A | 12/1975 | Ashworth | |
| 4,151,379 | A | 4/1979 | Ashworth | |
| 4,593,404 | A * | 6/1986 | Bolin | 381/82 |
| 4,914,750 | A | 4/1990 | Lawson | |
| 5,058,173 | A | 10/1991 | Ashworth | |
| 5,287,413 | A | 2/1994 | Ashworth | |
| 5,335,284 | A | 8/1994 | Lemons | |
| 5,400,412 | A * | 3/1995 | King et al. | 381/395 |
| 5,473,700 | A | 12/1995 | Fenner, Jr. | |
| 5,546,469 | A * | 8/1996 | Donahoe | 381/152 |
| 6,098,743 | A * | 8/2000 | McGrath | 181/150 |
| 6,144,746 | A | 11/2000 | Azima et al. | |
| 6,151,402 | A | 11/2000 | Azima et al. | |

(Continued)

OTHER PUBLICATIONS

Aearo Ear Specialty Composites, "CONFOR CF-EG grade environmentally friendly foams", *Product Bulletin 118*, www.earshockandvibe.com, (2003), 1-8.

(Continued)

*Primary Examiner*—Vivian Chin
*Assistant Examiner*—Jason R Kurr
(74) *Attorney, Agent, or Firm*—Hovey Williams LLP

(57) ABSTRACT

An acoustic bracket system comprising a bracket section containing an insert holder; coupling means connectable to the bracket section; and an insert securable to the insert holder and adapted to hold one or more acoustic transducers is provided. In one embodiment the coupling means comprises two flanges. In one embodiment the coupling means comprises a plurality of hooks. The acoustic bracket system is tunable and securable to framing members which are designed to support a sounding board. In one embodiment, the insert is a conformable foam insert with an opening into which each of the one or more acoustic transducers is securable. The acoustic bracket system is acoustically tunable with mass, stiffness and damping to enhance the audio performance of the one or more acoustic transducers.

21 Claims, 4 Drawing Sheets

U.S. PATENT DOCUMENTS 6,169,809 B1 1/2001 Azima et al.
6,181,799 B1 1/2001 Azima et al.
6,188,775 B1 2/2001 Azima et al.
6,192,136 B1 2/2001 Azima et al.
6,198,831 B1 3/2001 Azima et al.
6,201,878 B1 3/2001 Azima et al.
D440,220 S 4/2001 Dunk et al.
6,215,881 B1 4/2001 Azima et al.
D442,162 S 5/2001 Dunk et al.
D442,163 S 5/2001 Dunk et al.
D442,164 S 5/2001 Dunk et al.
6,243,473 B1 6/2001 Azima et al.
6,266,426 B1 7/2001 Azima et al.
6,278,787 B1 8/2001 Azima
6,282,298 B1 8/2001 Azima et al.
6,285,770 B1 9/2001 Azima et al.
6,301,562 B1 10/2001 Azima et al.
6,304,661 B1 10/2001 Azima et al.
6,307,942 B1 10/2001 Azima et al.
6,324,052 B1 11/2001 Azima et al.
6,324,294 B1 11/2001 Azima et al.
6,327,369 B1 12/2001 Azima et al.
6,332,029 B1 12/2001 Azima et al.
6,333,575 B1 12/2001 Bank et al.
6,342,749 B1 1/2002 Azima
6,342,831 B1 1/2002 Azima
6,345,102 B1 2/2002 Davis et al.
6,351,542 B2 2/2002 Azima et al.
6,356,641 B1 3/2002 Warnaka et al.
6,359,991 B1 3/2002 Azima et al.
D455,131 S 4/2002 Reynaga et al.
6,372,066 B1 4/2002 Bream
6,377,695 B1 4/2002 Azima et al.
6,389,935 B1 5/2002 Azima et al.
6,397,972 B1 6/2002 Bank et al.
6,399,870 B1 6/2002 Azima et al.
6,404,894 B1 6/2002 Azima et al.
6,427,016 B1 7/2002 Azima et al.
6,442,282 B2 8/2002 Azima et al.
6,443,586 B1 9/2002 Azima et al.
6,456,723 B1 9/2002 Bank et al.
D466,885 S 12/2002 MacFarlane et al.
6,496,586 B1 12/2002 Hayes et al.
6,510,919 B1 * 1/2003 Roy et al. ..... 181/173
6,519,347 B1 2/2003 Morecroft et al.
6,519,349 B1 2/2003 Azima et al.
6,522,755 B1 2/2003 Warnaka et al.
6,522,760 B2 2/2003 Azima et al.
6,546,106 B2 4/2003 Azima
6,553,124 B2 4/2003 Azima et al.
6,610,237 B2 * 8/2003 Azima et al. ..... 264/259
6,618,487 B1 9/2003 Azima et al.
6,676,879 B1 1/2004 Azima
6,694,038 B1 2/2004 Azima
6,751,329 B2 6/2004 Colloms et al.
6,751,333 B1 6/2004 Azima et al.
6,760,461 B2 7/2004 Azima et al.
6,795,561 B1 9/2004 Bank
6,813,362 B2 11/2004 Bank et al.
6,826,285 B2 11/2004 Azima
6,839,444 B2 1/2005 Ellis et al.
6,865,277 B2 3/2005 Bank et al.

OTHER PUBLICATIONS

Dynamic Control, "Xtreme Dynamat", www.dynamat.com, (2001),1-2.

* cited by examiner

ACOUSTIC BRACKET SYSTEM

CROSS-REFERENCE TO RELATED APPLICATION

This application claims the benefit under 35 U.S.C. 119 (e) of U.S. Provisional Application No. 60/552,776 filed on Mar. 12, 2004.

FIELD

The invention relates generally to bracket systems, and more specifically to an acoustic bracket system.

BACKGROUND

Inertial acoustic transducers are used in various applications to transfer acoustic energy. Such transducers need to be securely attached to a sounding board to function properly. Historically, transducers have been attached to a sounding board with either a mechanical device (e.g., screws, vacuum cups, etc.) or with some type of bonding method, both of which typically have relatively small contact areas with the sounding board. Such methods are inadequate for long service life in applications in which the sounding board is a brittle material, such as gypsum used in common residential and commercial construction. Specifically, if the force from the transducer is sufficiently high, the localized fracture strength of the material in the area of the attachment can be exceeded, causing the material to fracture, eventually leading to catastrophic material failure.

Bonded and screw attachments also have additional problems, as they are subject to the effects of gravity acting on the transducer, and can therefore bend and twist. Screw attachments cause additional problems by concentrating the stresses on the sounding board. Specifically, as the combination of acoustic and gravitational forces are applied to the relatively small contact area of the attachment on a sounding board such as a gypsum panel, the crystal structure of the gypsum begins to breakdown into a powder, thus reducing acoustic energy transfer over time. Vacuum cups often leak and ultimately lose suction over time.

It is also difficult to install transducers in walls or ceilings during either new construction or refurbishment of an existing structure using these methods. Specifically, mechanical and bonding techniques both require the acoustic transducer to be attached to a gypsum panel prior to its installation on a framing member. This is difficult to achieve in practice, since the transducer can not be positively positioned relative to the surrounding framing.

For the reasons stated above, and for other reasons stated below which will become apparent to those skilled in the art upon reading and understanding the present specification, there is a significant need in the art for an improved mounting system for inertial acoustic transducers.

SUMMARY

An acoustic bracket system comprising a bracket section containing an insert holder; coupling means connectable to the bracket section; and an insert securable to the insert holder and adapted to hold one or more acoustic transducers is provided. In one embodiment the coupling means comprises two flanges. In one embodiment the coupling means comprises a plurality of hooks. In one embodiment the hooks are contiguous with the bracket section. In one embodiment, the one or more acoustic transducers are magnetostrictive transducers, electrodynamic transducers or electrostrictive transducers, each having an inertial mass and an acoustically active face. In one embodiment, the inertial mass is increased by about 15 to 50% with the insert. In one embodiment, the insert is a conformable foam insert which can have an opening into which each of the one or more acoustic transducers is securable. In one embodiment, the conformable foam insert exhibits about a 0.014 to 0.7 kg/cm$^2$ (about 0.2 to ten (10) psi) increase from about 10 to 70% deflection when subjected to a static compression force. In one embodiment the acoustic bracket system further comprises a damping layer securable to a back side of the bracket section. In a particular embodiment, the damping layer is made from a viscoelastomeric material and foil. In one embodiment, the coupling means, insert holder and bracket section are made from a single piece of sheet metal.

In one embodiment, the acoustic bracket system is tunable to the one or more acoustic transducers and soundboard. In a particular embodiment, the bracket section has a height about 1.5 times a combined height of the one or more acoustic transducers. In one embodiment, the coupling means is connectable to an architectural framing member, which in turn is connectable to the sounding board. The sounding board can be made from natural or engineered materials. In a particular embodiment, the sounding board is selected from the group consisting of a glass panel, gypsum drywall panel, fiberglass panel, metallic panel, metallic alloy panel, composite panel, wood panel, wood product panel, stone system, and any combination thereof. The one or more transducers can be centered between each framing member, although the invention is not so limited. In most embodiments, the acoustically active face of each of the one or more acoustic transducers is flush with the back surface of the sounding board when the sounding board is connected to the framing members.

The present invention further comprises an acoustic system comprising an acoustic bracket system; and one or more acoustic transducers securable to the acoustic bracket system. In one embodiment the acoustic bracket system is securable to architectural framing members with flanges or hooks. In one embodiment the framing members are selected from the group consisting of wall studs, joists and grid suspension systems. In one embodiment, the system further comprises a sounding board.

The present invention further provides a method comprising positioning a tunable acoustic bracket system on a pair of framing members; installing an acoustic transducer to the acoustic bracket system; and attaching a sounding board to the framing member. In one embodiment the method further comprises installing a damping layer on the tunable acoustic bracket system prior to attaching the sounding board to the framing member. In one embodiment the method further comprises, prior to the positioning step, tuning the tunable acoustic bracket system to the acoustic transducer and sounding board. In one embodiment, the method further comprises installing one or more additional acoustic transducers to the acoustic bracket system. In one embodiment, the method further comprises connecting an audio system to the acoustic transducer.

The present invention provides, for the first time a tunable bracket system designed to span the space between two framing members of a framing system in such a manner as to positively position an acoustic transducer or a plurality of transducers relative to the framing system and to each other. The acoustic bracket system fixes the transducer in space, prior to the attachment of a sounding board, such as a gypsum panel. The transducer acoustic output element, i.e., the acoustically active face of the transducer, is aligned to the sounding board to ensure proper acoustic coupling between the transducer and sounding board which is permanently attachable to its framing.

DETAILED DESCRIPTION

In the following detailed description of sample embodiments of the invention, reference is made to the accompanying drawings which form a part hereof, and in which is shown by way of illustration specific sample embodiments in which the invention may be practiced. These embodiments are described in sufficient detail to enable those skilled in the art to practice the invention, and it is to be understood that other embodiments may be utilized and that logical, mechanical, electrical and other changes may be made without departing from the spirit or scope of the present invention. The following detailed description is, therefore, not to be taken in a limiting sense, and the scope of the invention is defined only be the appended claims.

The present invention provides in one embodiment an acoustic bracket system which provides support to an inertial acoustic transducer in communication with a sounding board, without causing any detrimental effect to the sounding board itself. The acoustic bracket system described herein also improves overall acoustic performance of an audio transducer and sounding board by providing, for the first time, a tunable foundation against which the inertial reaction mass portion or reaction mass (hereinafter "inertial mass") of the transducer can push. Specifically, the acoustic bracket system itself adds mass to the inertial mass, causing a greater motion and velocity to be imparted to the active side (or face) of the transducer.

Figure 1:
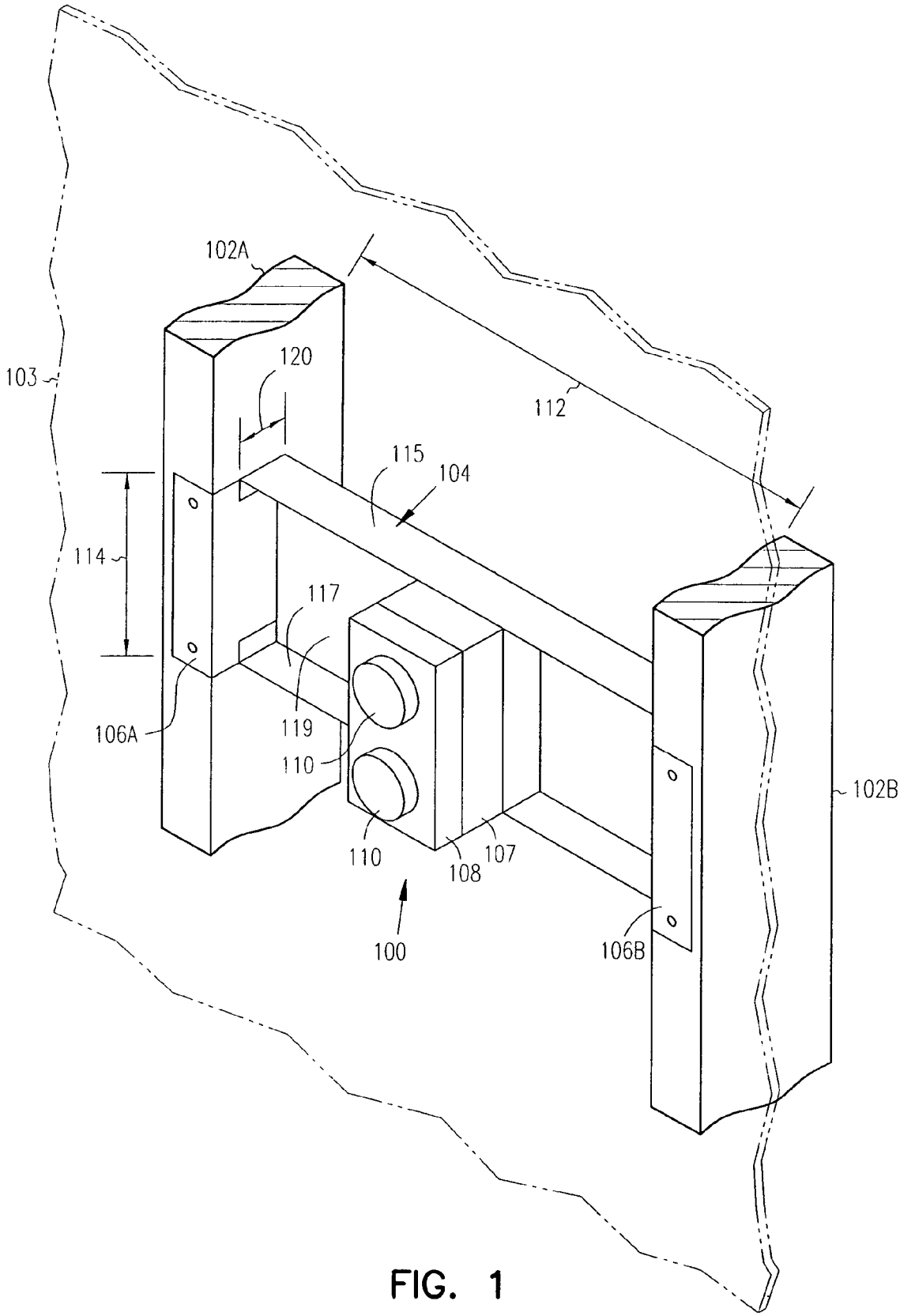
FIG. 1 is a simplified partially cut-away perspective view of an acoustic bracket system with installed transducers, the acoustic bracket system connected to framing members which in turn have a sounding board secured thereto, in accordance with one embodiment of the invention.

FIG. 1 shows one embodiment of an acoustic bracket system 100 in place between architectural framing members 102A and 102B (hereinafter "framing members"), to which a sounding board 103 (often referred to as a "soundboard"), has been secured. In this embodiment, the acoustic bracket system 100 is comprised of a bracket section 104, an insert holder 107, an insert 108, and framing member coupling means (hereinafter "coupling means") 106A and 106B (which in this embodiment comprises two flanges connected to or contiguous with opposite ends of the bracket section 104). The bracket section 104 is comprised of an upper section (hereinafter "upper rib") 115, a lower section (hereinafter "lower rib") 117, and a middle section (hereinafter "vertical member") 119. Two transducers 110 are secured to the insert 108 in FIG. 1, although the invention is not so limited. Any number of transducers 110 can be secured to the insert 108. In some embodiments, only one transducer 110 is secured to the insert 108. In other embodiments, three or more transducers 110 are secured to the insert 108. In some embodiments, multiple transducers are connected with a cross-over filter as described in U.S. patent application Ser. No. 60/519,161 entitled, "Resonant Enclosure for Sound Enhancement," filed Nov. 12, 2003, which is herein incorporated by reference in its entirety.

The sounding board 103 can be made from a variety of materials, including, any type of natural or engineered material. This includes, but is not limited to, gypsum, wood, wood composites, fiber reinforced plastics, metals, metal alloys, glass, plastic, stones, including fabricated stones, and any combination thereof. Therefore, the sounding board 103 can be any one of a number of common semi-rigid structures such as glass panels, gypsum drywall panels, fiberglass panels, metallic panels, metallic alloy panels, composite panels typically consisting of a fiber reinforced resin system of skins with a structural core, wood panels, wood product panels (including wood laminates, wood composites, etc.), stone systems (including real and cultured stone systems), and so forth. The sounding board 103 can further have any suitable size and shape. In one embodiment, the sounding board 103 is about 0.4 to 3.7 m (about 1.3 to 12 ft) in length, about 0.4 to 1.5 m (about 1.3 to five (5) ft) in length and about 0.64 to 1.9 cm (about 0.25 to 0.75 in) in thickness. In a particular embodiment, the sounding board 103 is about 1.8 m (about six (6) ft) by about 2.4 m (about eight (8) ft) and about 1.3 cm (about 0.5 in) thick. The surface of the sounding board 103 can be either curved or flat. In most instances, the sounding board 103 is a semi-rigid structure having a mechanical impedance of between about 100 and 6000 N-m/sec.

As FIG. 1 shows, the acoustic bracket system 100 is designed to span a distance 112 between framing members 102A and 102B. The framing members 102A and 102B can be any type of framing members used for ceilings, walls and floors, such as ceiling joists, drywall suspension grids, and the like. Such framing members 102A and 102B can be made from a variety of materials, such as wood, steel and plastic.

Coupling means 106A and 106B can take on any configuration as long as it can perform the intended function of coupling the acoustic bracket system 100 to one or more framing members. The coupling means 106A and 106B can be secured to the framing members 102A and 102B by conventional mechanical securing means, including screws, nails, etc., or by any other means, including any type of adhesive means, including cement, magnetic coupling means, and so forth. Each coupling means 106A and 106B can also be press fit (i.e., friction fit) between the framing members 102A and 102B. In an alternative embodiment shown in FIG. 6, the coupling means comprise a plurality of hooks 606A-606D. The particular type of coupling means used to secure the acoustic bracket system 100 to the framing members 102A and 102B is also dependent on the type of material used for the framing member 102A and 102B, which can include wood, plastic, steel, and so forth. Additionally, distance 112 can vary, depending on the type and location of the construction. In most embodiments distance 112 is between about 15.2 and 50.8 cm (about six (6) and 20 in), although the invention is not so limited. In one embodiment, distance 112 is the standard distance between wall studs, namely about 36.8 cm (about 14.5 in), which correlates with a 40.6 cm (approximately 16 in) distance from center to center.

The upper rib 115 and lower rib 117 of the bracket section 104 are substantially horizontal components, joined together by the vertical member 119, a substantially vertical component, as shown in FIG. 1. In most embodiments in which the coupling means 106A and 106B are flanges, the upper and lower ribs, 115 and 117, respectively, have bent substantially vertical ends which are bonded (i.e., with spot welding, etc.) to the coupling means 106A and 106B, as shown in FIG. 1. In most embodiments, the vertical member 119 is contiguous with the coupling means 106A and 106B, although the components can be joined together as separate pieces. In most embodiments the upper and lower ribs, 115 and 117, respectively, are contiguous with the vertical member 119, although these components can also be joined together as separate pieces. In one embodiment, all the components of the bracket section 104 are contiguous with each other, i.e., formed from a single piece of material.

Although the components of the bracket section 104 are shown as substantially flat rectangular pieces, in practice, any or all of these components can also be curved or rounded. In one embodiment the vertical member 119 is arch-shaped. The various dimensions of the bracket section 104 (and coupling means 106A and 106B) can also vary. In practice, however, it is the depth, i.e., width, of the upper and/or lower ribs, 115 and 117, respectively, represented by distance 120, which most affects the frequency response function of the acoustic bracket system 100, although the length and thickness of these components, as well as the dimensions of the other components of the bracket section 104 may also have some effect on the frequency response function of the acoustic bracket system 100. Therefore, when tuning the acoustic bracket system 100 to the frequency response of the transducers 110 and sounding board 103, in most embodiments distance 120 for the upper rib 115 and/or lower rib 117 will be increased or decreased as needed so that the acoustic bracket system 100 is properly tuned to the transducers 110 and sounding board 103. In most embodiments, distance 120 will be about the same for the upper rib 115 and lower rib 117, although the invention is not so limited.

The height of the vertical member 119, represented by distance 114 can also vary, but does not need to be more than about two to three times greater than the combined height of the transducers 110 present. Excess height does not necessarily provide additional benefit in performance and also incurs additional costs in materials. In one embodiment, distance 114 is about 1.5 times the height of the combined height of the transducers 110 present. In another embodiment, distance 114 ranges from about the same as the combined height of the transducers 110 up to nearly 1.5 times the combined height of the transducers 110. In yet another embodiment, distance 114 is less than the combined height of the transducers 110, down to about one-half the height or less. It is important, however, that the vertical member 119 have a minimum height sufficient to provide adequate support for the transducers 110.

Although the coupling means 106A and 106B are shown in FIG. 1 as having about the same height as the vertical member 119, as indicated by distance 114, the invention is not so limited. The height and/or thickness of the coupling means 106A and 106B can also be varied and may not necessarily be the same height and/or thickness as the vertical member 119, although the coupling means 106A and 106B, which are shown as flanges as in FIG. 1, will both typically have about the same height and thickness. In one embodiment, the height and/or thickness of the coupling means 106A and 106B is less than the height and/or thickness of the vertical member 119. In another embodiment, the height and/or thickness of the coupling means 106A and 106B is more than the height and/or thickness of the vertical member 119.

In an alternative embodiment, there is no upper rib 115 and no lower rib 117 and coupling means 106A comprises a single flat piece of material securable to the front (narrow) face of the framing member 102A. In this embodiment, coupling means 106B also comprises a single flat piece of material securable to the front (narrow) face of the framing member 102B. In this embodiment, the vertical member 119 is secured to or otherwise contiguous with these single flat pieces of material (106A and 106B) such that it is also flush with the front (narrow) face of the framing members 102A and 102B when the acoustic bracket system 100 is installed on the framing members 102A and 102B.

In the embodiment shown in FIG. 1, two transducers 110 are oriented in a substantially vertical alignment, although the invention is not so limited. In another embodiment more than two transducers 110 are oriented in a substantially vertical alignment. In yet another embodiment, two or more transducers are oriented in a substantially horizontal alignment. In yet another embodiment there is only one transducer 110. In yet other embodiments, the transducers 110 are arranged in any configuration suitable for the particular application. Such a configuration can include transducers 110 located at alternating heights to form any type of regular or irregular pattern, such as a grid pattern, a substantially triangular shape, substantially square shape, substantially rectangular shape, or any type of open pattern, such as a series of triangles, and so forth. Essentially, any configuration is possible as long as the acoustic bracket system 110 is properly sized and tuned as described herein.

In one embodiment, two transducers 110 are oriented as shown in FIG. 1, each transducer 110 having a diameter of about 2.54 to 10.2 cm (about one (1) in to four (4) in). In a particular embodiment each has a diameter of about 5.1 cm (about two (2) in) and are spaced about 7.6 cm (about three (3) in) apart, on center. In one embodiment, vertical member 119 and coupling means 106A and 106B are both about the same height (distance 114), namely about 12.7 to 17.8 cm (about five (5) to seven (7) in). In one embodiment, the width of the upper rib 115 and lower rib 117, i.e., distance 120, is about 0.32 to 5.1 cm (about 0.13 to two (2) in). In a particular embodiment, the width of the upper rib 115 and lower rib 117 is about 2.54 cm (about one (1) in). The depth of each coupling means 106A and 106B (i.e., the dimension in the same plane as distance 120) can range from about 0.32 to 8.9 cm (about 0.13 to 3.5 in) or more, depending on the size of the framing member being used, with the upper and lower ribs, 115 and 117, respectively, securable anywhere along that dimension. The thickness of each component of the bracket section 104 and both coupling means 106A and 106B can range from about 0.32 to 0.97 cm (about 0.13 to 0.38 in) and are not necessarily all the same dimension.

The acoustic bracket system 100 can be made from any suitable material capable of performing the intended function. This includes, but is not limited to, stamped or drawn sheet metal, die cast metal, molded plastic, and the like. In most embodiments, the various components of the acoustic bracket system 100 (other than the insert 108 and the damping section 220 discussed below) are made from the same material and are contiguous with each other, although the invention is not so limited. It is possible that, in some embodiments, the bracket section 104, insert holder 107, and/or coupling means 106A and 106B are made separately and joined together by suitable attachment means, such as adhesive or mechanical means. In such instances, it is also possible that the various components may be made from different materials.

In an alternative embodiment, the bracket section 104 and/or the coupling means 106A and 106B are adjustable in size, such as with a two-part sliding mechanism or any mechanism known in the art that provides adjustability to a bracket. However, such an embodiment may introduce undesirable secondary rattles or movements in the system.

Figure 2:
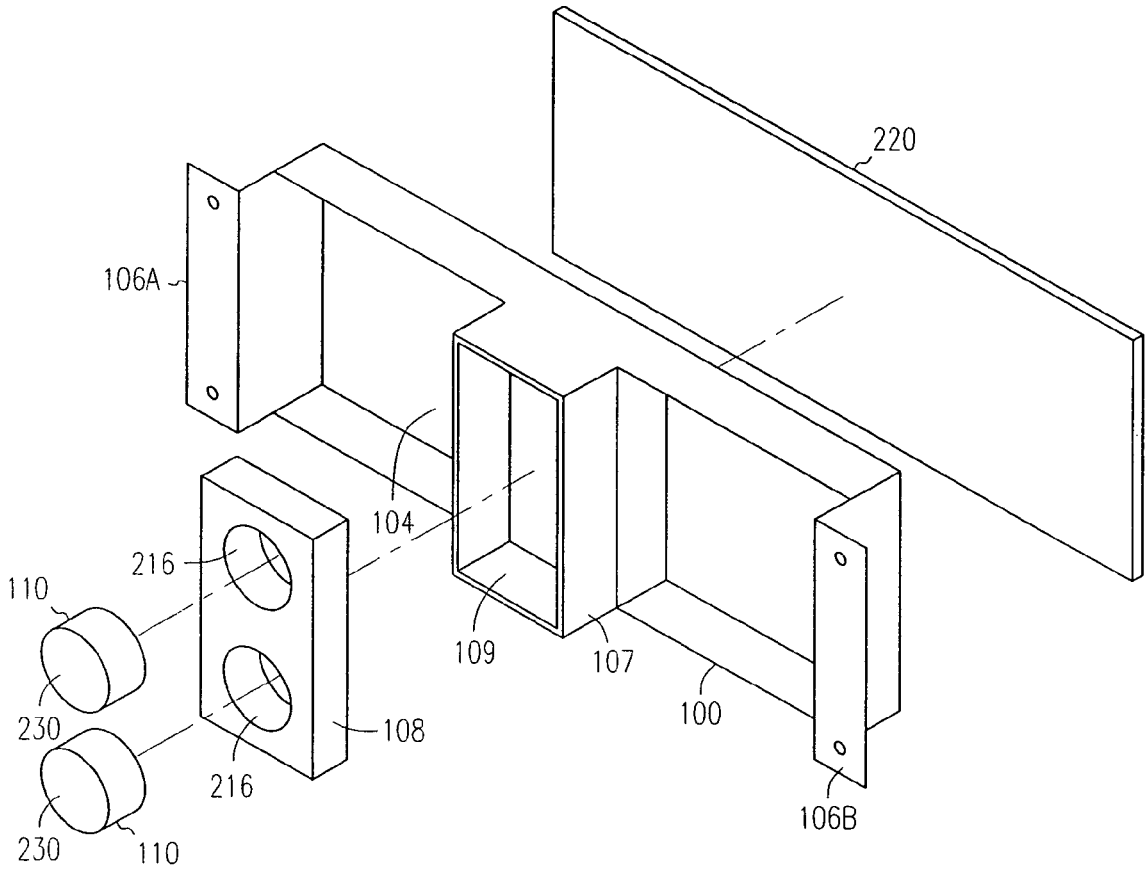
FIG. 2 is an exploded view of the acoustic bracket system and transducers of FIG. 1, the acoustic bracket system further comprising a damping layer, in accordance with one embodiment of the invention.

The various components of the acoustic bracket system 100 and surrounding components can be seen in more detail in FIG. 2, including an acoustically active face 230 on each transducer 110. Additionally, in this embodiment, a damping layer 220 is shown. The damping layer 220 serves to dynamically stiffen the bracket section 104 to improve the overall acoustic output of each transducer 110. The damping layer 220 can provide a 30 to 40% reduction in the inertial mass velocity and thus about a 10% improvement in the sound level output of the sounding board 103.

The damping layer 220 can be made from any suitable material which can perform the intended function of damping vibrations. In one embodiment the damping layer 220 has a viscoelastomeric core with a foil covering. In another embodiment, the damping layer 220 has a butyl-based core with an aluminum constraining covering. The damping layer 220 can also have any suitable thickness. In one embodiment, the thickness ranges from about 0.32 to 0.95 cm (about 0.13 to 0.38 in). In a particular embodiment, the damping layer 220 has a thickness of about 0.64 cm (about 0.25 in). In a particular embodiment, the damping layer 220 is Dynamat Xtreme® made by Dynamic Control having offices in Hamilton, Ohio, a material having a black butyl based core with an approximately 0.64 cm (about four (4) mil) aluminum constraining layer and a thickness of 1.7 mm (0.07 in). In another embodiment, the damping layer 220 is Dynamat Original® or Dynamat Plate®, also made by Dynamic Control.

Figure 3:
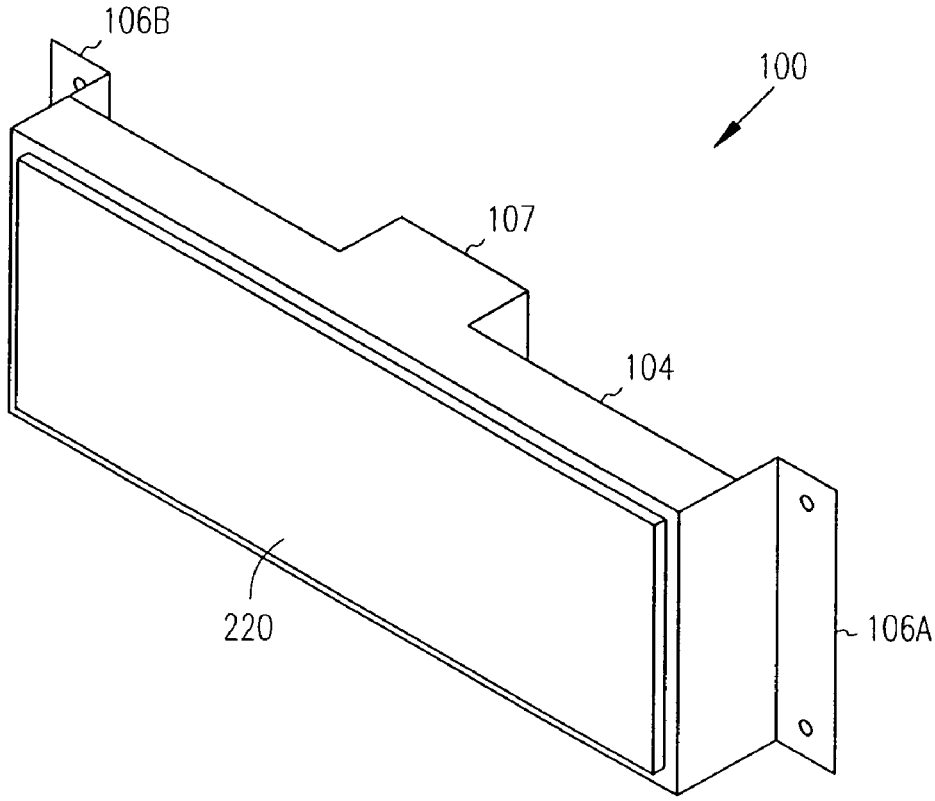
FIG. 3 is a simplified perspective view of the optional damping layer shown in FIG. 2 in place on the acoustic bracket system, in accordance with one embodiment of the invention.

FIG. 3 shows one embodiment of an acoustic bracket section 100 with the damping layer 220 secured to the backside of the vertical member 119 of the bracket section 104, although the invention is not so limited. The damping layer 220 can be secured to any portion of the acoustic bracket system 100 and more than one damping layer 220 can be used in various locations. The damping layer 220 can be secured using any suitable type of securing means, such as any type of adhesive, adhesive liner, epoxy, and the like, as is known in the art.

Referring again to FIG. 2, the insert holder 107 is preferably designed to protrude from the bracket section 104 as shown, although the invention is not so limited. However, with this design, the acoustically active face 230 of each transducer 110 can be substantially flush with the back surface of the sounding board 103 when properly installed in the insert 108, and thus in contact or communication with the sounding board 103. Additionally, the insert holder 107 can be located anywhere along the bracket section 104 but in one embodiment is at or about the center area of the bracket section 104 so that the transducers 110 are located about mid-way between the framing members 102A and 102B, although the invention is not so limited. In some instances it may be desirable to offset the transducers between the framing members 102A and 102B in order to avoid obstacles such as electrical wires and pipes.

The insert holder 107 can be designed to receive the insert 108 in any suitable way. In the embodiment shown in FIG. 2, the insert holder 107 has an insert holder opening 109 into which the insert 108 is secured. If desired, additional securing means, such as adhesive means can be used to hold the insert 108 in place. In other embodiments, the insert holder 107 has a substantially flat face onto which the insert 108 is placed and secured with suitable securing means known in the art, such as adhesive means. Although both the insert holder 107 and insert 108 are shown as substantially rectangular, in practice, these components can take on any shape and size as long as they can perform the intended function. In one embodiment the insert holder 107 is rounded or cup-shaped. In one embodiment the insert holder 107 is a stamped, drawn, or spun component.

The insert 108 can be made from any suitable material which can provide proper adequate support and damping. In one embodiment, the material is made from any type of foam, plastic gel, metal, and the like. In one embodiment the material is a slow recovery material that can serve as a shock absorber without causing any energy amplification. Preferably, the insert 106 is made from a conformable foam material that exhibits stress relaxation properties in combination with rate sensitive stiffness behavior. Such properties are essentially contradictory in that the material compresses and conforms when subjected to a constant force, thereafter gradually recovering once the force is removed, but can also behave as a semi-rigid foam which resists collapse when directly impacted. Specifically, a material exhibiting rate sensitive stiffness behavior or strain rate sensitive stiffness behavior reacts with more stiffness when subjected to a high velocity impact as compared with a static impact. In one embodiment, the insert 108 exhibits about a 0.014 to 0.7 kg/cm$^2$ (about 0.2 to ten (10) psi) increase from about 10 to 70% deflection when subjected to a static compression force. In one embodiment, the conformable foam insert 108 exhibits about a 0.014 to 0.7 kg/cm$^2$ (about 0.2 to ten (10) psi) increase from about 10 to 70% deflection at rates of from about 5.1 to 152.4 cm/min (about two (2) to 60 in/min) when subjected to a dynamic compression force. In one embodiment, the insert 108 is a foam product referred to as CONFOR®, a material made by EAR Specialty Composites Inc., having offices in Indianapolis, Ind.

With use of the insert 108, optimal acoustic coupling is provided between the sounding board 103 and the acoustic transducer 110 without inducing undesirable stresses within the acoustic transducer 110 itself. Specifically, the rate sensitive stiffness of the insert 108 acoustically couples the transducer inertial mass with the acoustic bracket system 100, thus increasing the effective inertial mass of the acoustic transducer 110. (The inertial mass (not shown) is located at the end of the acoustic transducer 110 opposing the active face 230). In most embodiments the inertial mass is increased by about 15 to 50% with the insert 108 to create a larger "effective" inertial mass. Such properties also allow an object of a given size inserted into an opening in the material of lesser size to be "frictionally captured." In other words, a friction force exists between the object and the material that acts to contain the object in place.

Figure 4:
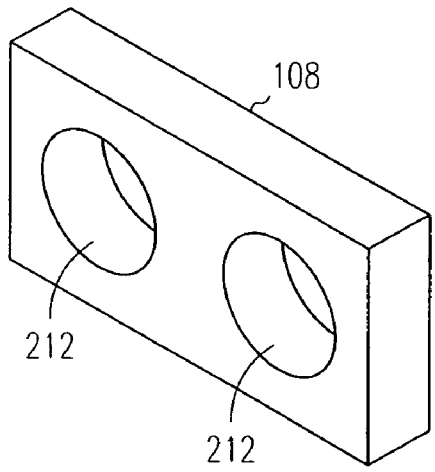
FIG. 4 is a simplified perspective view of an insert portion of the acoustic bracket system shown in FIGS. 1 and 2, in accordance with one embodiment of the invention.

The insert 108 is preferably designed to have transducer holding means, such as the two insert openings 216 shown in FIGS. 2 and 4, although the invention is not so limited. Such openings are preferably sized smaller than the diameter of the transducer 110 by about five (5) to 50%, thus allowing each transducer 110 to be "frictionally captured" as described above. Other transducer holding means can also be used including any type of magnetic coupling means for transducers 110 other than magnetostrictive transducers. In other embodiments, the transducers 110 are secured through any type of adhesive means. Additionally, the material used for the insert 108 can extend beyond the insert holder 107, if desired, such as onto a portion or all of the surfaces of the vertical member 119. In other embodiments, the material additionally or alternative extends onto a portion or all of the surfaces of the upper rib 115 and/or lower rib 117.

Virtually any type of inertial acoustic transducer 110 can be used with the acoustic bracket system 100 described herein, including, but not limited to, electrodynamic transducers. The transducers 110 can also have any suitable type of driver made from a smart material, preferably one that is driven when an electric potential is applied to its surface, including electrostrictive, magnetostrictive and piezoceramic transducers. The particular type of transducer 110 utilized depends on the intended use. In most embodiments, the transducer 110 will have a resonant frequency of between about 150 and 20,000 Hz, although the invention is not so limited. In one embodiment, the transducers 110 are driven with Terfenol® or Terfenol-D® drives made by Etrema Products, Inc., having offices in Ames, Iowa. In a particular embodiment, a combination of an XDrive™ and DDrive™ brand transducers made by the Assignee, having offices in Ames, Iowa, are used. The combined frequency response of these two transducers ranges from about 150 to 20,000 Hz. In another embodiment, transducers made by Clark Synthesis Tactile Sound, a division of Clark Synthesis Inc., having offices in Littleton, Colo. are used. In yet another embodiment, Rolen-Star audio transducers made by Richtech Enterprises having offices in Stockton, California, are used.

Referring again to FIG. 1, the present invention provides a system in which the acoustic performance of a transducer or plurality of transducers 110 is enhanced by the use of a mechanical boundary, i.e., the acoustic bracket system 100, which provides a mechanical foundation to which the transducer (containing the inertial mass) 110 can be fixed and push against. Physically, the bracket system 100 serves as a mass, spring and damper system, with the natural bending stiffness of the bracket serving as the spring. As a result, dynamic force generated by the one or more acoustic transducers 110 is used to accelerate the sounding board 103 and inertial mass. The resulting velocity of the sounding board 103 and inertial mass is proportional to the dynamic mass of the sounding board 103 and inertial mass. Acceptable performance is typically realized when the ratio between the inertial mass and the dynamic mass of the sounding board 103 is greater than about ten (10). However, improving the performance of the acoustic transducer 110 by increasing the inertial mass becomes limited by diminishing returns and increased cost of the inertial mass.

Multiple transducers 110 can be connected together both with wire and wireless means. The transducers 110 can further be connected to an audio system that includes conventional speakers, in-wall speakers and subwoofers, and in-wall subwoofers. In one embodiment, the transducers 110 are driven from common audio amplifiers with or without signal equalization, crossovers, or other signal processing means both analog and digital, as is known in the art.

The parameters of the acoustic bracket system 100 can be selected in such a manner as to provide a dynamic response in concert with the first extensional mode of the acoustic transducer 100 and sounding board 103 to increase the overall sound quality of the sounding board 103. Proper tuning of the acoustic bracket system 100 comprises selecting the appropriate stiffness, mass and damping to provide the desired response with the acoustic transducer and sounding board 103. For example, if the acoustic bracket system 100 is being used with an acoustic transducer 110 and sounding board 103 having a low cut-off frequency of 150 Hz, i.e., the first extensional resonant frequency is 150 Hz, the acoustic bracket system 100 must be tuned to operate properly with this frequency.

In order to determine if a selected acoustic bracket system 100 is properly tuned, various tests can be performed. Specifically, the first bending mode of the bracket section 104 can be measured by performing a frequency response function test. This typically comprises mounting an accelerometer at about the center point of the operational position of the acoustic transducer 110, the bracket section 104 suspended between two fixed points with the coupling means 106A and 106B (or 606A-606D) or any other suitable coupling means. Next, a hammer with an instrumented force gauge commonly referred to as a "force hammer" is used to tap the opposing side of the bracket section. The signals from the accelerometer and force gauge are then provided to a multi-channel spectrum analyzer, which produces a frequency response spectrum. This spectrum is measured and analyzed for anti-resonance behavior of no more than plus or minus one (1) octave in frequency, and preferably no more than about plus or minus 50% of one (1) octave in frequency than the lowest frequency cut off of the sounding board and acoustic transducer system. The ideal frequency response or anti-resonance of the acoustic bracket system is actually slightly lower than the lowest frequency cut-off of the sounding board and acoustic transducer system, as this is known to enhance the low frequency portion of the system response. For example, when the lowest frequency cut-off of the sounding board and the transducer is about 150 Hz, the ideal frequency response or anti-node of the acoustic bracket system is about 140 Hz or 13% of an octave lower than 150 Hz. However, a frequency of as low as about 75 Hz or as high as about 300 Hz would also work (i.e., within one (1) octave). Preferably, the frequency is between about 112.5 and 225 Hz. (i.e., within 50% of an octave).

If the anti-resonance is too low, the width of the upper rib 115 and/or lower rib 117 coupling means can be increased. If the anti-resonance is too high, the width of the upper rib 115 and/or lower rib 117 can be decreased. Small adjustments to the width of these components produce exponential results, as the widths of the upper and/or lower ribs, 115 and 117, respectively, are the primary components which control the bending stiffness of the entire acoustic bracket system 100. Of course, the dimensions of other parts of the acoustic bracket system 100 can also be varied, if desired, but adjustments to other dimensions will not have as great an impact on the overall frequency response of the acoustic bracket system 100 as compared with adjustments to the width of the upper and/or lower ribs, 115 and 117, respectively. Other variables which can be adjusted include, but are not limited to, the type of materials being used in the acoustic bracket system.

Figure 5:
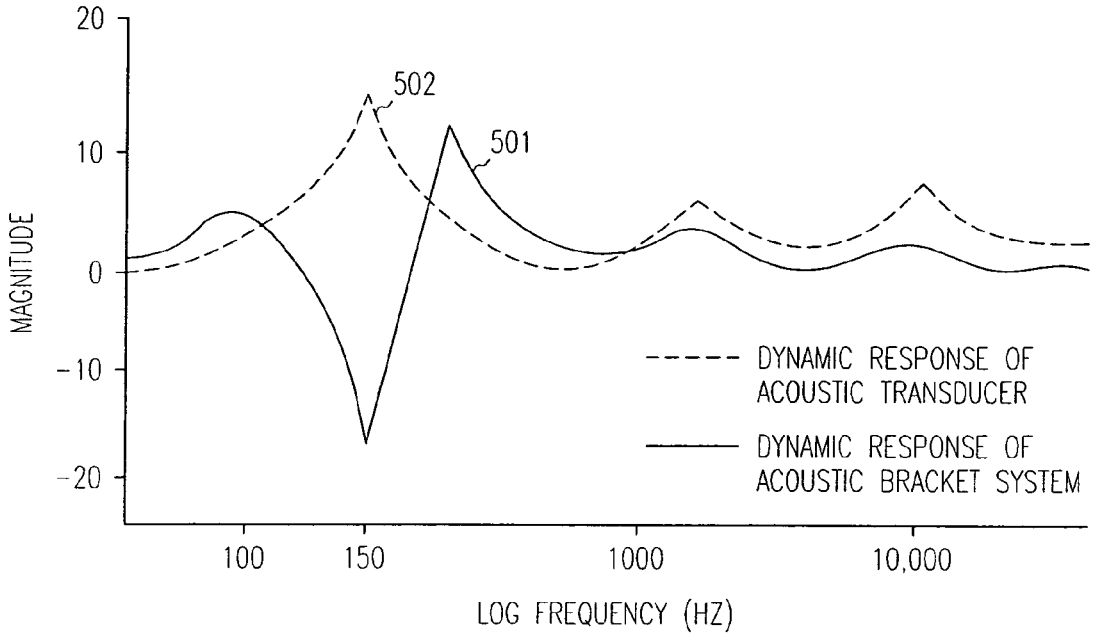
FIG. 5 is a graph showing a model acoustic transducer and sounding board system frequency response and a model acoustic bracket system frequency response, in accordance with one embodiment of the invention.

FIG. 5 shows a model dynamic response of an inertial acoustic transducer and sounding board 501 and a model dynamic response of an acoustic bracket system 502 properly tuned for this transducer and sounding board. Such responses are referred to as the "frequency response function" and is plotted as log frequency versus amplitude. As FIG. 5 shows, the anti resonance of the acoustic bracket system response 502 in this example is at about the same frequency as the lowest frequency mode of the transducer and sounding board response 501, albeit at different magnitudes. However, the difference in magnitude between the acoustic bracket system response 502 and the transducer and sounding board response 501 will not affect overall acoustic performance of the transducer and sounding board.

Future testing will likely include performing a number of frequency response tests using a variety of combinations of components. One set of tests will likely utilize the bracket section only suspended in free space. Other tests will likely utilize the bracket section and various types of coupling means combined and mounted to a support, such as various types of framing members made from varying materials. Other tests will likely be performed with the insert placed in the insert holder. Yet other tests will test the system with the damping layer installed. Yet other tests may vary the location and amount of insert material and/or damping layer or layers. Yet other tests will include various types and sizes of sounding boards. A series of tests such as this will help to identify the dynamic characteristics of each component, thus helping to optimize the system to provide optimized overall performance.

The present invention further provides a method comprising positioning a tunable acoustic bracket system on a pair of framing members; installing an acoustic transducer to the acoustic bracket system; and attaching a sounding board to the framing member. In one embodiment the method further comprises installing a damping layer on the tunable acoustic bracket system prior to attaching the sounding board to the framing member. In one embodiment the method further comprises, prior to the positioning step, tuning the tunable acoustic bracket system to the acoustic transducer. In one embodiment, the method further comprises tuning and installing one or more additional acoustic transducers to the acoustic bracket system. In one embodiment, the method further comprises connecting an audio system to the acoustic transducer. The present invention further provides a method for tuning an acoustic bracket system for use with one or more acoustic transducers as described herein.

Figure 6:
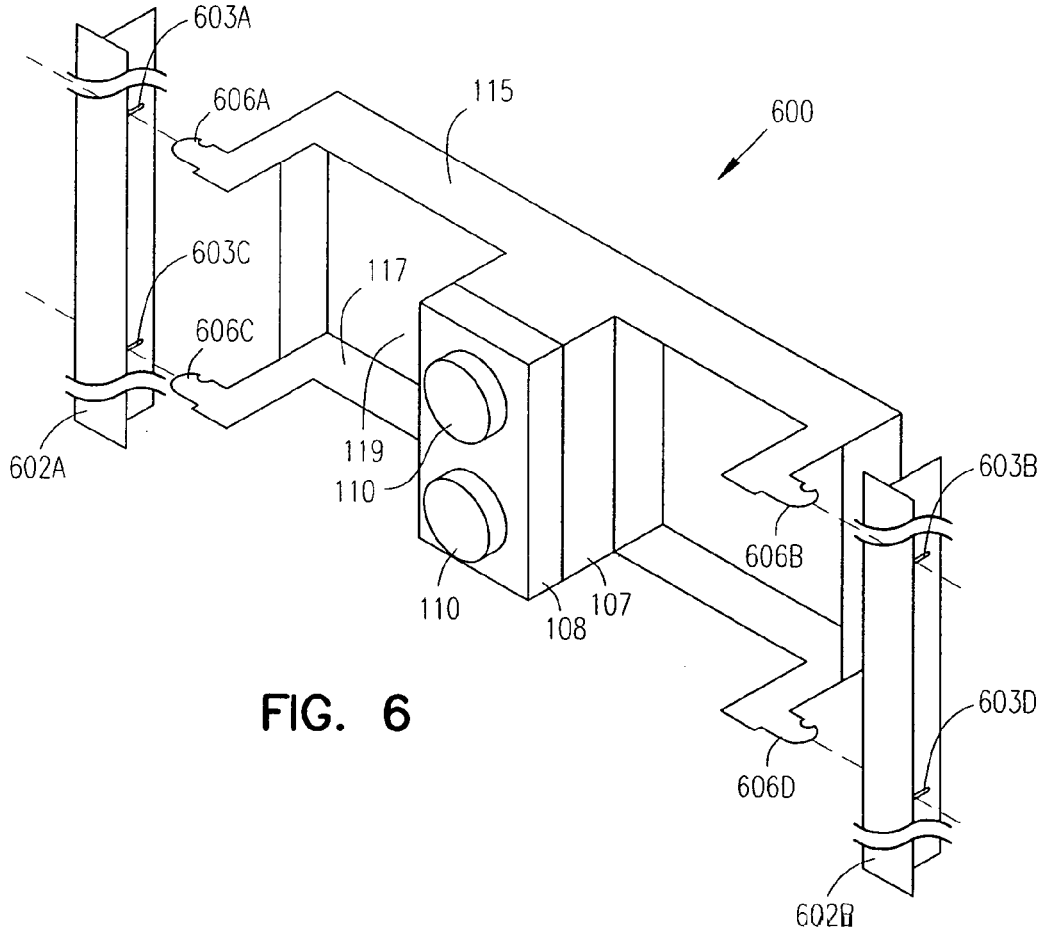
FIG. 6 is an exploded view of an alternative bracket system with installed transducers, the alternative acoustic bracket system shown mountable to crossbeams of a grid system in one embodiment of the present invention.

The present invention further provides an alternative acoustic bracket system 600 as shown in FIG. 6, for use with grid systems, such as ceiling grid systems having ceiling panels (not shown) as the sounding boards. As FIG. 6 shows, hooks 606A, 606B, 606C and 606D, rather than flanges (See 106A and 106B in FIG. 1), are used to secure the acoustic bracket system 600 to the framing members 602A and 602B. In this embodiment hooks 606A and 606C are connected to framing member 602A and hooks 606B and 606D are connected to framing member 602B. Also in this particular embodiment, the hooks (606A-606D) are essentially the end portions of extensions of both the upper rib 115 and lower rib 117. In other embodiments, the hooks 606 are separate components secured to the end portions of the upper and/or lower ribs, 115 and 117, respectively. In such embodiments, the upper and/or lower ribs, 115 and 117, respectively may again extend beyond the vertical member 119. The hooks 606A-606D couple with openings 603A-603D (known in the art as f-routes, typically stamped through the main and cross beams of the grid system) as shown. In this embodiment, hook 606A slides into opening 603A, hook 606B slides into opening 603B, and so forth.

Embodiments of the present invention provide for transducers to be installed to architectural framing members using an easy-to-install acoustic bracket system. The acoustic bracket system provides a long term solution to the problem of installing transducers on sounding boards by eliminating the relatively small and highly-stressed contact points with the sounding board used in current attachment methods. Instead, the tunable acoustic bracket system of the present invention is secured directly to framing members, although the design allows the active face of the transducer to be in communication with the back surface of the sounding board for optimal acoustic performance. As a result, no slow deterioration or sudden catastrophic failure of the sounding board occurs. Additionally, the acoustic bracket system is tunable and provides a fixed point against which the inertial mass of the transducer can push, thus increasing the inertial mass and enhancing the acoustic performance of the transducer.

As shown herein, the present subject matter can be implemented in a number of different embodiments. Other embodiments will be readily apparent to those of ordinary skill in the art. The elements, materials, geometries, orientations, dimensions, and sequence of operations can all be varied to suit particular acoustical requirements.

FIGS. 1 through 6 are merely representational and are not drawn to scale. As such, certain proportions may be exaggerated, while others may be minimized. FIGS. 1 through 6 are intended to illustrate various implementations of the subject matter that can be understood and appropriately carried out by those of ordinary skill in the art.

Although specific embodiments have been illustrated and described herein, it will be appreciated by those of ordinary skill in the art that any arrangement that is calculated to achieve the same purpose may be substituted for the specific embodiment shown. This application is intended to cover any adaptations or variations of the present subject matter. Therefore, it is manifestly intended that embodiments of this invention be limited only by the claims and the equivalents thereof.

What is claimed is:

1. An acoustic bracket system comprising:

a sounding board connectable to a framing member;

a bracket section containing an insert holder wherein the bracket section is comprised of an upper rib and lower rib, joined together by a vertical member and wherein the bracket section is tunable to the one or more acoustic transducers and the sounding board;

coupling means connectable to the bracket section; and an insert securable to the insert holder and adapted to hold one or more acoustic transducers wherein the insert is a conformable foam insert that has an opening into which each of the one or more acoustic transducers is securable, and the acoustically active face of each of the one or more acoustic transducers is flush with a back surface of the sounding board when the sounding board is connected to each framing member, and the bracket section provides a mechanical foundation for the one or more acoustic transducers.

2. The system of claim 1 wherein the coupling means comprises two flanges.

3. The system of claim 1 wherein the coupling means comprises a plurality of hooks.

4. The system of claim 3 wherein the plurality of hooks is contiguous with the bracket section.

5. The system of claim 1 wherein the one or more acoustic transducers are magnetostrictive transducers, each having an inertial mass and an acoustically active face.

6. The system of claim 5 wherein the inertial mass is increased by about 15 to 50% with the insert.

7. The system of claim 1 wherein the one or more acoustic transducers are electrodynamic or electrostrictive transducers, each having an inertial mass and an acoustically active face.

8. The system of claim 7 wherein the inertial mass is increased by about 15 to 50% with the insert.

9. The system of claim 1 wherein the conformable foam insert exhibits about a 0.014 to 0.7 kg/cm.sup.2 (about 0.2 to ten (10) psi) increase from about 10 to 70% deflection when subjected to a static compression force.

10. The system of claim 1 further comprising a damping layer securable to a back side of the bracket section.

11. The system of claim 10 wherein the damping layer is made from a viscoelastomeric material and foil.

12. The system of claim 1 wherein the coupling means, insert holder and bracket section are made from a single piece of sheet metal.

13. The system of claim 1 wherein the coupling means is connectable to an architectural framing member.

14. The system of claim 1 wherein the acoustic bracket system is tuned by adjusting the width of components selected from the group consisting of upper rib and lower rib.

15. The system of claim 14 wherein the vertical member has a height about 1.5 times a combined height of the one or more acoustic transducers.

16. The system of claim 1 wherein the sounding board is made from natural or engineered materials.

17. The system of claim 16 wherein the sounding board is selected from the group consisting of a glass panel, gypsum drywall panel, fiberglass panel, metallic panel, metallic alloy panel, composite panel, wood panel, wood product panel, stone system, and any combination thereof

18. The system of claim 17 wherein the one or more transducers are centered between each framing member.

19. The system of claim 1 wherein the acoustic bracket system is securable to architectural framing members with coupling means.

20. system of claim 19 wherein the coupling means are flanges or hooks.

21. The system of claim 20 wherein the framing members are selected from the group consisting of wall studs, joists and grid suspension systems.

* * * * *